US008522581B2

(12) United States Patent
Thompson

(10) Patent No.: US 8,522,581 B2
(45) Date of Patent: Sep. 3, 2013

(54) SAFETY SHIELD AND DOUBLE-LOCK LEG CUFFS

(75) Inventor: Charles E. Thompson, Greenville, PA (US)

(73) Assignee: CSI-Penn Arms, LLC, Jamestown, PA (US)

( * ) Notice: Subject to any disclaimer, the term of this patent is extended or adjusted under 35 U.S.C. 154(b) by 0 days.

(21) Appl. No.: 13/304,581

(22) Filed: Nov. 25, 2011

(65) Prior Publication Data

US 2013/0133382 A1 May 30, 2013

(51) Int. Cl.
*E05B 75/00* (2006.01)

(52) U.S. Cl.
USPC ..... 70/16

(58) Field of Classification Search
USPC ..... 70/15–17; 224/914
See application file for complete search history.

(56) References Cited

U.S. PATENT DOCUMENTS 3,616,665 A 11/1971 Rosenthal
3,740,977 A 6/1973 Stefansen et al.
4,840,048 A * 6/1989 Elam ..... 70/16
5,007,257 A 4/1991 Thompson
5,680,781 A * 10/1997 Bonds et al. ..... 70/16
5,732,576 A * 3/1998 Moore et al. ..... 70/16
6,000,249 A * 12/1999 Wilber ..... 70/16
6,886,374 B2 * 5/2005 Clifton, Jr. ..... 70/16
7,010,943 B1 * 3/2006 Earl ..... 70/16
7,181,935 B1 * 2/2007 Earl ..... 70/16
7,284,399 B1 * 10/2007 Sisco ..... 70/16

* cited by examiner

*Primary Examiner* — Christopher Boswell
(74) *Attorney, Agent, or Firm* — Bennet K. Langlotz; Langlotz Patent & Trademark Works, Inc.

(57) ABSTRACT

A safety shield for double-lock leg cuffs having a first lock for disengaging or releasing the leglets after the same have been applied to the legs of a prisoner, and a second lock for fixing the preset contracted position of the leglets on the prisoner's legs. The box-like shield comprises access slots in a wall thereof through which a portion of the associated leg cuff key may be inserted to actuate the second lock without opening the shield or revealing the first lock or removing the shield from the leg cuffs. This arrangement permits the shields to be secured over the leg cuffs prior to application to a prisoner and thereby enhances the officer's safety. The safety shield is also suitable for use with handcuffs including a pair of wristlets pivotally and rotatably connected by either an enlarged ring portion or a short link chain.

17 Claims, 5 Drawing Sheets

FIG. 1
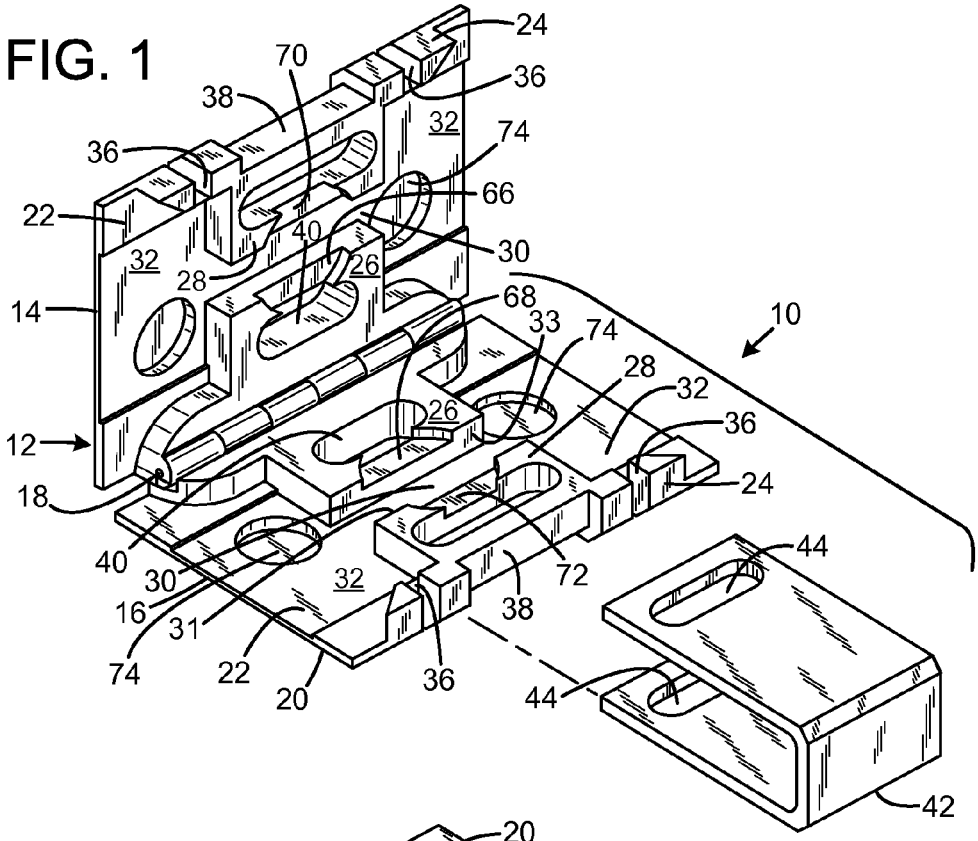
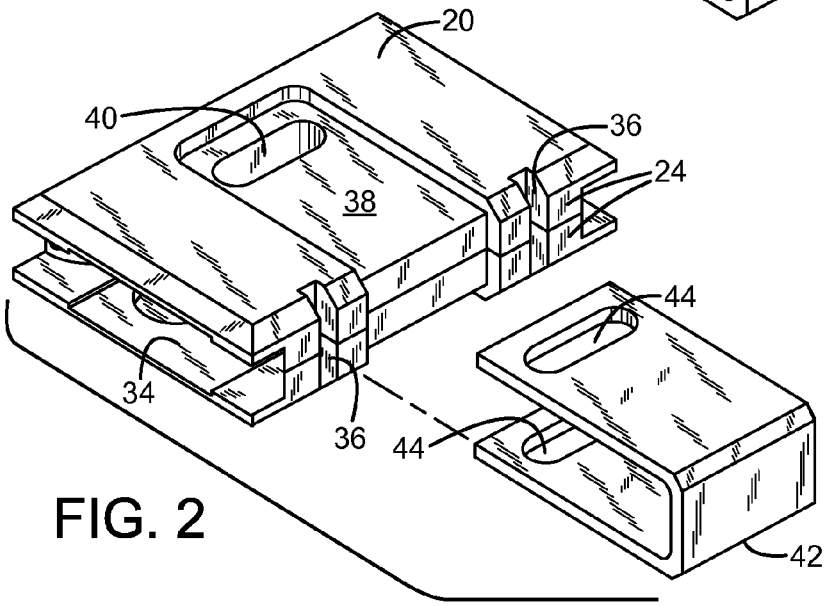
FIG. 2

SAFETY SHIELD AND DOUBLE-LOCK LEG CUFFS

FIELD OF THE INVENTION

This invention relates generally to a cover or shield cooperable with prisoner leg cuffs for making the leg cuffs safer and more tamper-proof and, more particularly, to a safety shield for use with double-lock leg cuffs.

BACKGROUND OF THE INVENTION

Leg cuffs used by police and law enforcement officers worldwide for prisoner restraint are basically standardized in construction and operation. Typically, the leg cuffs comprise a pair of leglets either hingedly connected or, more frequently, joined together by a short link chain. Each leglet has a single strand or ratchet bar which automatically engages the teeth in a double strand and is thus pivotal or rotatable through the double strand in only one direction. Once applied to the legs of a prisoner, the ratchet bar can be released or disengaged only with a key insertable into a keyhole or first lock on the leglet.

While on the legs of a prisoner, the ratchet bar is still squeezable or rotatable inwardly through the double strand to make the encircling circumference progressively smaller. This capability could of course cause injury to the prisoner. To prevent such injury, standard leg cuffs are provided with a second lock for fixing the leglet circumference preset by the officer on the prisoner's leg. The second lock typically comprises a recessed rod within a small hole that can be actuated by a projection or pin on the key carried by the officer. Use of the key to open the first lock can also open or disengage the second lock so that the leg cuffs are ready for further use.

Use of the leg cuffs with chain-connected leglets can frequently place arresting officers in dangerous and even life threatening situations. Since the connection between the leglets is flexible and rotatable, the manacled prisoner is able to manipulate his legs with a large degree of freedom. Picking of the locks is a possibility. Also, when applying the leg cuffs, the officer is standing close to the prisoner and is in physical jeopardy if the prisoner is violent or struggling. If the leg cuffs are applied to only one leg at a time, the physical danger is in no way reduced because the rotatable and pivotal connection between the two leglets affords the officer scant leverage even over the leg that is manacled.

Efforts have been made to improve the safety aspects of conventional handcuffs. Thus, for example, U.S. Pat. No. 3,616,665 shows a shield that was passed over the handcuff chain to cover the key openings and maintain the chain in a taut condition. U.S. Pat. No. 3,740,977 shows a hinged cover assembly that was applied over the wristlets and connecting chain to rigidify the connection between the prisoner's wrists and also encase the key openings. Both of the identified prior structures were characterized by a disadvantageous feature in that they made no provision for actuation of the second or double lock. The handcuffs thus needed first to be applied to the prisoner's wrists and the second lock then actuated to fix the setting of the wristlets. Only after this dangerous operation was completed was the shield or cover applied to the handcuffs. The officer thus was subjected to the kinds of dangers described above during the handcuffing operation. Furthermore, none of these prior efforts function with leg cuffs.

U.S. Pat. No. 5,007,257 discloses a safety shield for double-lock handcuffs, which is a lockable box that encompasses the mechanisms of both bracelets, and the connecting chain. This is unsuitable for use to secure the lock mechanisms of leg cuffs, even if one were employed on each leglet, because each box would be free to slide along the chain away from the leglet, exposing the mechanism.

There thus exists a need for further improving the safety aspects of leg cuff use and, particularly the need exists for a means to provide greater protection for the arresting officer during the initial leg cuffing operation as well as subsequent thereto.

SUMMARY OF THE INVENTION

The present invention provides a shield for leg cuffs which substantially eliminates the dangers and problems described. The inventive shields can be applied to the leg cuffs before the prisoner is leg cuffed to greatly improve the officer's advantage. The invention nonetheless permits the leg cuffs to be double locked as required.

Briefly, the invention comprises an improvement over the type of handcuff cover shown in U.S. Pat. No. 5,007,257 by making the cover compatible with a new form of leg cuffs. The invention thus comprises two hinged, box-like assemblies adapted to be locked over the leg cuff chain and leglets and the keyholes of the first locks. The shields are modified by the addition of circular recesses that receive an enlarged ring portion of the leg cuff chain. The shields comprise additionally access means in a wall thereof aligned with the second locks when the cover is operationally positioned and closed over a leglet of a pair of leg cuffs. The access means permits access to the second locks with a portion of the key carried by the officer. As a result, the leg cuffs may be operationally locked within the shields prior to the time that their use in shackling a prisoner is required. Once the leg cuffs are applied to the prisoner's legs, the officer may easily actuate the second locks to securely double-lock the leg cuffs. A single shield can still be used with a standard pair of handcuffs.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

FIG. 1 is an exploded perspective view showing the shield of the invention in the open, inoperative position;

FIG. 2 is a similar view with the hinged sections of the shield body closed;

DESCRIPTION OF THE CURRENT EMBODIMENT

Figure 3:
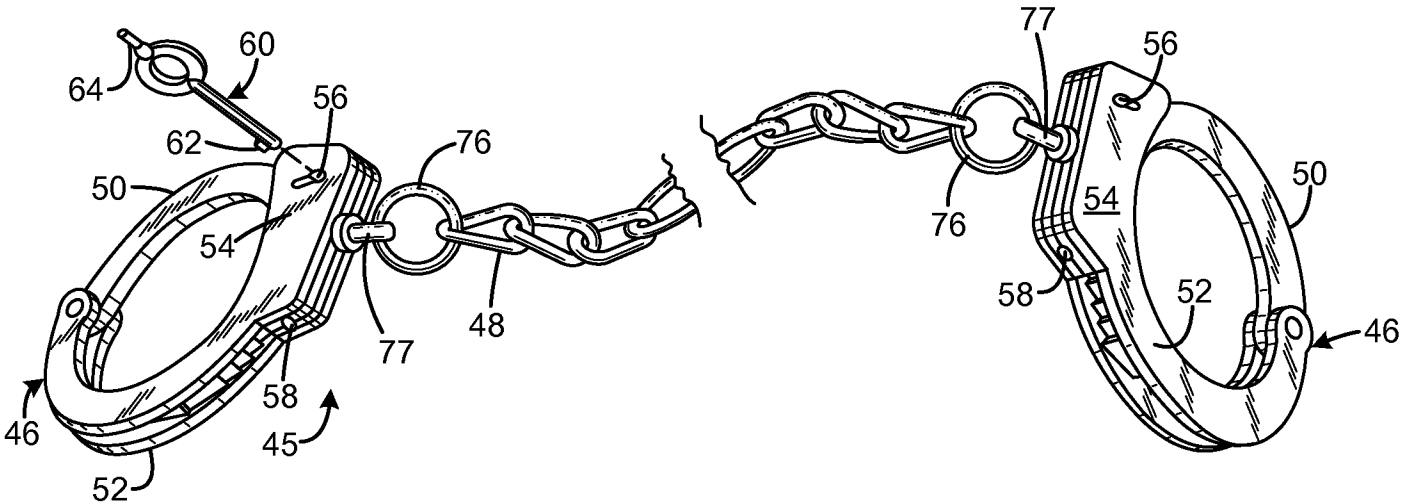
FIG. 3 is a perspective view of a set of conventional double-lock leg cuffs and associated key.

Referring with greater particularity to the drawings, the reference numeral 10 indicates generally a safety shield embodying the principles of the invention. Safety shield 10 comprises a box-like body 12 having a pair of plate-like members 14 and 16 hingedly connected along a sidewall by a hinge rod 18. The members 14 and 16 are substantial mirror images of each other, comprising an outer face 20, an inner face 22, and a sidewall 24 opposite the hinged connection.

Each inner face 22 comprises a pair of raised sections 26 and 28 shaped to define a chain-receiving channel 30 therebetween and a pair of cuff-receiving recessed areas 32, 32, opening to the opposite ends of the face 22. The flat floor of each recessed area 32 defines a circular recess 74. The raised sections 26 and 28 are also shaped to define two recesses each 66, 68 and 70, 72.

When the members 14 and 16 are operationally closed and brought into face-to-face contact, the recessed areas 32 provide a cavity 34 as seen in FIG. 2. Similarly, the recessed areas 66, 68, 70, and 72 form a generally flat circular ring-receiving cavity when the members 14 and 16 are operationally closed and brought into face-to-face contact. The ring-receiving cavity is at a midpoint of the chain-receiving channel 30. The portions of the channel 30 on either side of the ring-receiving cavity areas 66, 68, 70, and 72 are considered channel constrictions 31, 33 that are substantially narrower than the diameter of the ring-receiving cavity. Thus, as will be discussed below, a chain having a ring element with a diameter sized to be closely received in the cavity will be captured by the closed safety shield, so that the shield may not be pulled away from a cuff residing in the recessed area 32. The constrictions 31, 33 immediately separate the ring receiving cavity from the cuff-receiving areas 32.

The use of two constrictions is not necessary, but is preferred to provide a shield that may be attached in either orientation, and is also versatile for use with typical short-chain handcuffs. In alternative embodiments, only one constriction is needed between the ring and cuff, to maintain the shield over the mechanism of the cuff. The circular recesses 74 enable the shield to accept a particular security handcuff locking mechanism that protrudes from the body of the handcuff and surrounds the key hole.

The sidewall 24 is formed with openings 36, 36, adjacent the opposite ends thereof which communicate with their respective recessed areas 32. In the embodiment illustrated, the openings 36 are formed by vertical cut-outs or slots and, as seen FIGS. 2, 4 and 5, the mated slots of the operationally closed body 12 provide access means to the cavities 34 for reasons which will become apparent as the description proceeds.

A continuous recess or groove 38 is formed in and extends around the outer face 20 and sidewall 24 of each of the body members 14 and 16, and the raised sections 26 comprise oblong slots 40 opening to their respective outer faces. A U-shaped retainer member 42 formed as an articulated planar body is slidably receivable in the continuous groove 38 of the closed body 12, and the legs of the retainer member have oblong slots 44, 44, of complementary configuration and adapted to align with the slots 40. The aligned slots 40 and 44 are adapted to receive a zip-tie, padlock, or clip means (not shown) for locking the shields 10 in the secure closed condition shown in FIG. 4.

Referring now to FIG. 3, there is illustrated a set of double-lock leg cuffs 45 comprising a pair of leglets 46, 46, pivotally and rotatably connected by a long link chain 48 with enlarged ring portions 76 on either end. The ring 76 is sized with a diameter to be closely received in the cavity formed by ring-receiving recesses 66, 68, 70, 72. The ring is separated from the cuff body by a swivel link 77. The swivel 77 has a diameter smaller than that of the ring 76, and provides a spacing between the ring 76 and cuff body. The swivel fits closely within the constriction 31, 33 of channel 30.

Each leglet 46 comprises a ratchet bar 50 pivotally connected to a double strand leglet body 52 having internal teeth (not shown) which permit rotation of the ratchet bar only inwardly therethrough, but automatically prevent withdrawal in the opposite direction. Leglet body 52 comprises an enlarged head portion 54 carrying first lock means 56 in the form of a keyhole in a planar face thereof. Head portion 54 comprises further a second lock means 58 in the form of a small recessed rod engageable through a small hole in a side edge of the head portion.

A conventional key 60 cooperates with the leg cuffs 45. Key 60 comprises at one end a finger 62 insertable into the first lock means keyhole 56. At its opposite end, the key 60 comprises a projection or pin 64 which is insertable into the opening in the side edge of the leglet head 54 for actuating the second lock means 58.

Figure 4:
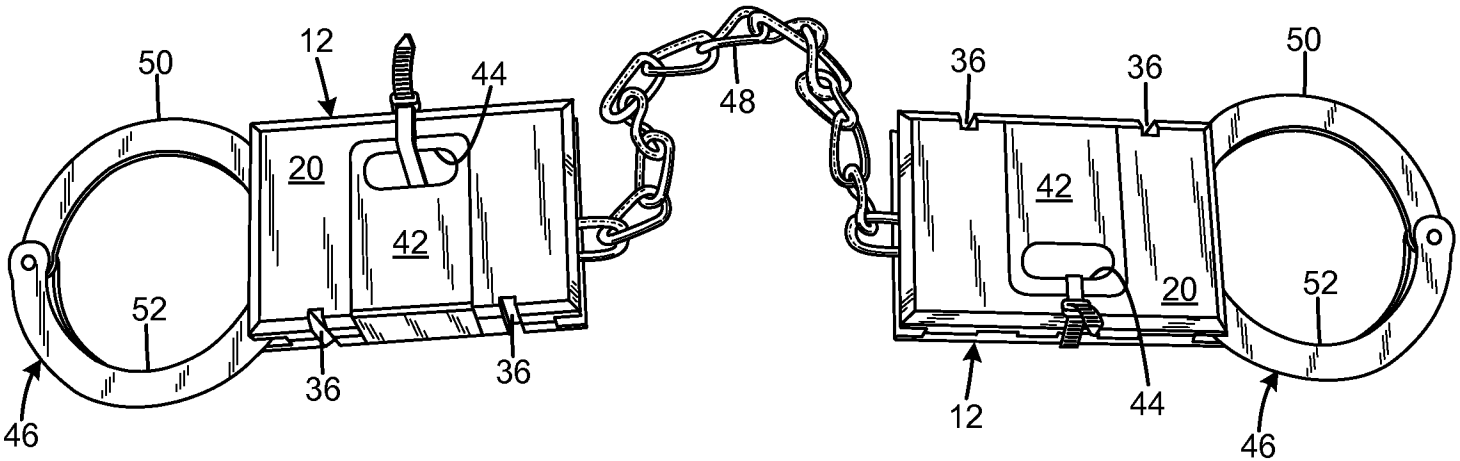
FIG. 4 is a perspective view of the safety shields operationally locked over the leg cuffs prior to application to the legs of prisoner.
Figure 5:
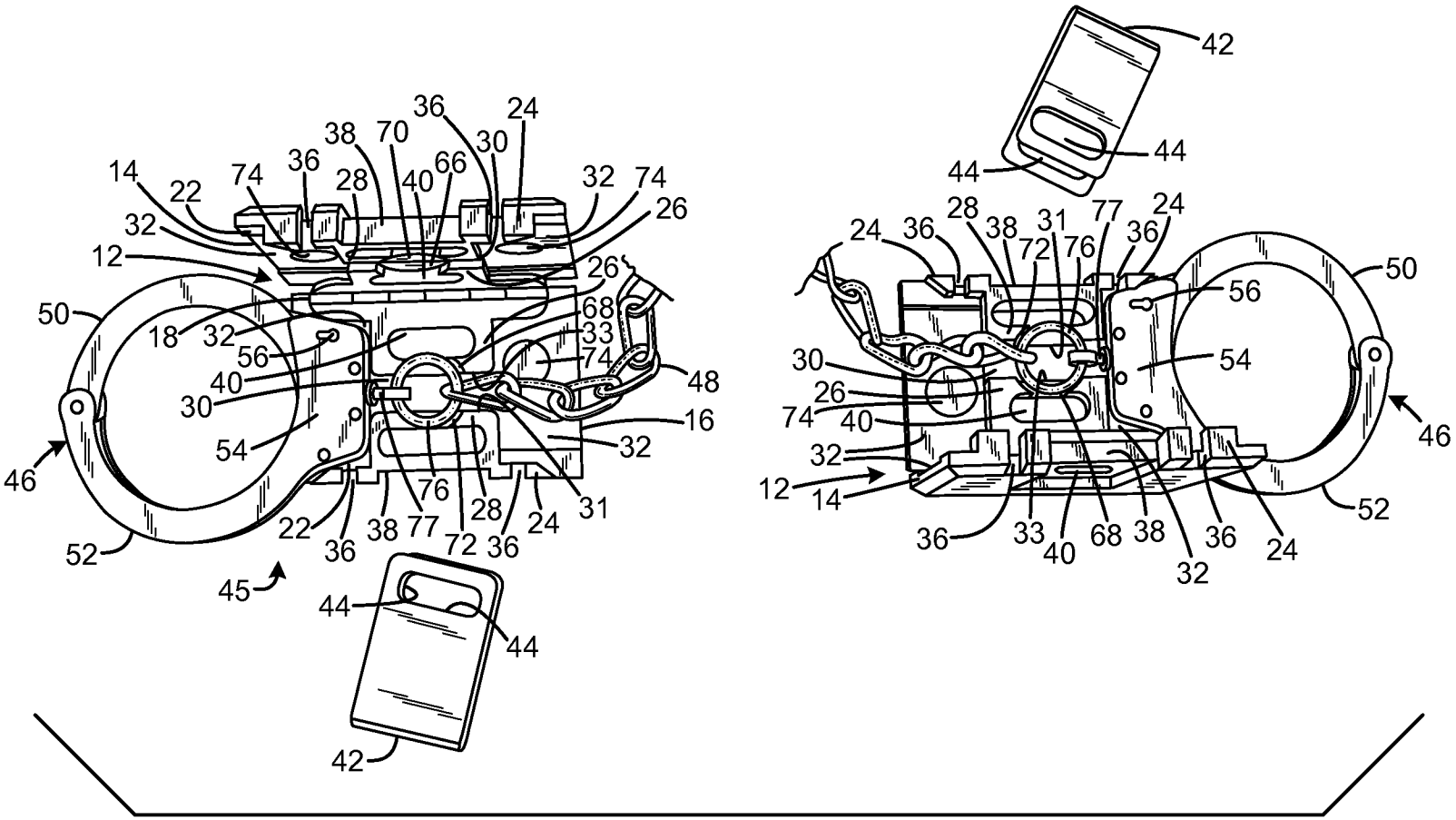
FIG. 5 is an exploded perspective view with the shields in the open, inoperative position with the leg cuffs received therein.

Operation of the safety shields 10 may now be best appreciated by referring to FIGS. 4 and 5. Preparatory to shackling a prisoner, the officer can insert leg cuffs 45 in the body 12 with the chain 48 in the channel 30, with the enlarged ring portions 76 seated in the cylindrical cavities formed by recessed areas 66, 68, 70, and 72, and with the leglet heads 54 in the cavities 34. The officer may then close the body, slide the retainer member 42 to encompass the body in a closed position, and securely lock the retainer onto the body with a zip-tie, padlock, or the like.

The cylindrical cavities capture the enlarged ring portions and hold the shields up against the leglets 46, preventing them from sliding along the chain to expose the leglet mechanism. The leglets may be in the open and disengaged condition. The officer can now apply the leg cuffs to the legs of a prisoner, set the leglets to the desired encircling dimension, and then actuate the second lock means 58 by pushing the key pin 64 through the access openings 36. When the leg cuffs require removal, the finger 62 of the key 60 is inserted into the keyhole 56 to reset the second lock means and unlock the first lock means.

The shield parts may be conveniently molded of suitable plastics or metal, and it will be appreciated that the invention enables the officer to carry the leg cuffs operationally secured in the safety shields at all times if desired. Even in dangerous situations where the officer is able to manacle only one leg, the rigid assembly affords substantial leverage for subduing the prisoner. If desired, or when conditions permit, the shields may of course be attached after the leg cuffs have been applied to a prisoner's legs.

Figure 6:
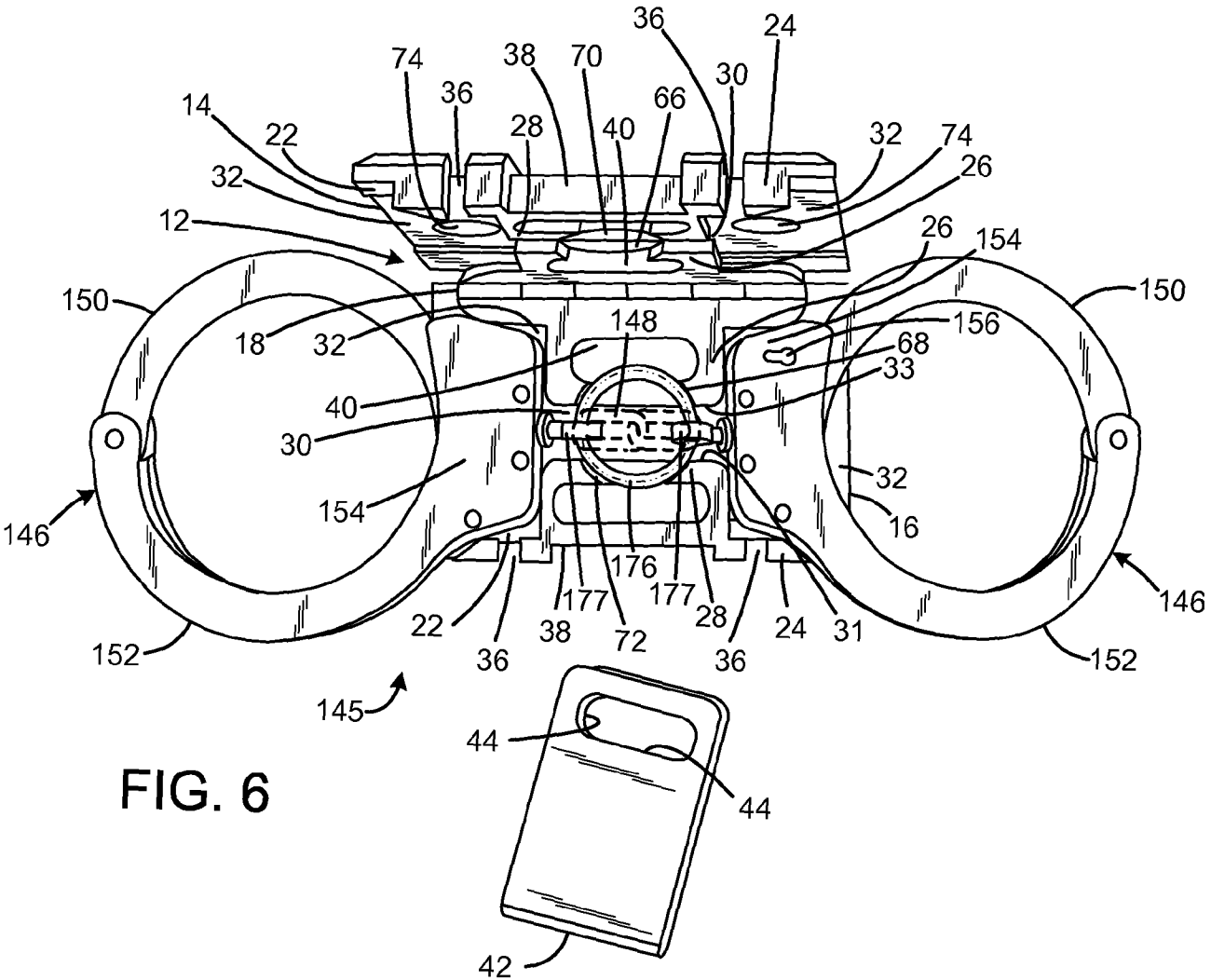
FIG. 6 is an exploded perspective view with the shields in the open, inoperative position with an improved or conventional set of double-lock handcuffs received therein.

Referring now to FIG. 6, there is illustrated an improved set of double-lock handcuffs 145 comprising a pair of wristlets 146, 146, pivotally and rotatably connected by an enlarged ring portion 176. The ring 176 is sized with a diameter to be closely received in the cavity formed by ring-receiving recesses 66, 68, 70, 72. The ring is separated from the cuff body by a swivel link 177. The swivel 177 has a diameter smaller than that of the ring 176, and provides a spacing between the ring 176 and cuff body. The swivel fits closely within the constriction 31, 33 of channel 30. Alternatively, a conventional set of double-lock handcuffs comprising a pair of wristlets pivotally and rotatably connected by a short link chain 148 instead of the enlarged ring portion 176 may be used.

Each wristlet 146 comprises a ratchet bar 150 pivotally connected to a double strand wristlet body 152 having internal teeth (not shown) which permit rotation of the ratchet bar only inwardly therethrough, but automatically prevent withdrawal in the opposite direction. Wristlet body 152 comprises an enlarged head portion 154 carrying first lock means 156 in the form of a keyhole in a planar face thereof. Head portion 154 comprises further a second lock means (not shown) in the form of a small recessed rod engageable through a small hole in a side edge of the head portion.

A conventional key 60 cooperates with the handcuffs 145. Key 60 comprises at one end a finger 62 insertable into the first lock means keyhole 156. At its opposite end, the key 60 comprises a projection or pin 64 which is insertable into the opening in the side edge of the wristlet head 154 for actuating the second lock means.

Preparatory to shackling a prisoner, the officer can insert improved handcuffs 145 in the body 12 with the enlarged ring portion 176 seated in the cylindrical cavities formed by recessed areas 66, 68, 70, and 72 and the wristlet heads 154 in the cavities 34, close the body, apply the retainer member 42, and securely lock the rigid assembly with a padlock or the like. The cylindrical cavities capture the enlarged ring portion and hold the shield up against the wristlets 46, preventing them from sliding to expose the wristlet mechanism. If a conventional set of double-lock handcuffs is used, the chain 148 is placed in the channel 30. The wristlets 146 may be in the open and disengaged condition. The officer can now apply the handcuffs to the wrists of a prisoner, set the wristlets to the desired encircling dimension, and then actuate the second lock means by pushing the key pin 64 through the access openings 36. When the handcuffs require removal, the finger 62 of the key 60 is inserted into the keyhole 156 to reset the second lock means and unlock the first lock means.

It will be appreciated that the invention enables the officer to carry the handcuffs operationally secured in the safety shield at all times if desired. Even in dangerous situations where the officer is able to manacle only one wrist, the rigid assembly affords substantial leverage for subduing the prisoner. If desired, or when conditions permit, the shield may of course be attached after the handcuffs have been applied to a prisoner's wrists. It should also be appreciated that the language and expressions used herein are for purposes of description only and changes and modifications may be made by those skilled in the art without departing from the spirit and scope of the invention which is defined in the appended claims.

I claim:

1. An enclosure for a cuff restraint having a cuff and an extending tether having an enlarged intermediate portion, the enclosure comprising:

first and second body portions movable between an open position and a closed position;

when in the closed position, the first and second portion defining a cuff chamber for closely receiving a portion of the cuff;

when in the closed position, the first and second portion defining a channel for receiving at least a portion of the tether;

the channel having an enlarged portion for receiving the enlarged portion of the tether;

the channel having a first narrow portion narrower than the enlarged portion, and positioned between the cuff chamber and the enlarged portion; and the first and second portion enabling removal and insertion of the cuff restraint when in the open position.

2. The enclosure of claim 1 wherein the first and second portions are hingedly connected to each other.

3. The enclosure of claim 1 including a removable clamp encompassing the first and second body portion when in the closed position.

4. The enclosure of claim 1 wherein when in the closed position, the first and second portion define a second cuff chamber opposite the cuff chamber for closely receiving a portion of a second cuff connected to the tether.

5. The enclosure of claim 1 further comprising the channel having a second narrow portion narrower than the enlarged portion, and positioned on the opposite side of the enlarged portion from the first narrow portion.

6. The enclosure of claim 1 wherein the enlarged portion is a circle.

7. The enclosure of claim 1 wherein the enlarged portion is centered along the length of the channel.

8. A cuff restraint comprising:

a cuff with a lock mechanism and operable to adjustably encompass a limb;

a tether extending from the cuff;

the tether having a first enlarged portion;

the tether having a second portion narrower than the first enlarged portion and positioned between the first enlarged portion and the cuff;

the tether having a third portion narrower than the first enlarged portion and positioned adjacent the first portion and away from the second portion and the cuff; and the tether having a second enlarged portion connected to the third portion.

9. The cuff restraint of claim 8 wherein the tether is a chain.

10. The cuff restraint of claim 9 wherein the enlarged portions are a link of the chain having a greater width than an adjacent link such that the adjacent link may fit in a constricted passage that the enlarged portions may not pass through.

11. The cuff restraint of claim 8 wherein the enlarged portions are rings.

12. The cuff restraint of claim 8 including a second cuff connected to the opposite end of the tether.

13. The cuff restraint of claim 12 wherein the second cuff is proximate to the second enlarged portion.

14. The cuff restraint of claim 12 wherein the cuffs are leg cuffs with a tether of at least one foot length such that a wearer may walk while restrained by the cuff restraint.

15. The cuff restraint of claim 12 wherein the cuffs are handcuffs.

16. The cuff restraint of claim 15 wherein the enlarged portions are rings.

17. The cuff restraint of claim 15 wherein the second portion between the first enlarged portion and the cuff is a swivel link.

* * * * *